United States Patent [19]

Goff

[11] Patent Number: 4,914,759

[45] Date of Patent: Apr. 10, 1990

[54] ADJUSTABLE SHOWER HOLDER

[76] Inventor: Daniel C. Goff, 3808 Claridge Rd. North, Mobile, Ala. 36608

[21] Appl. No.: 201,907

[22] Filed: Jun. 3, 1988

Related U.S. Application Data

[63] Continuation-in-part of Ser. No. 93,754, Sep. 8, 1987, abandoned.

[51] Int. Cl.[4] ..... A47K 3/02

[52] U.S. Cl. ..... 4/605; 4/615; 239/283; 239/530; 248/75; 248/297.2

[58] Field of Search ..... 4/601, 605, 615, 191; 239/282, 283, 525, 530, 588; 248/295.1, 297.2, 297.3, 75

[56] References Cited

U.S. PATENT DOCUMENTS

| | | | |
|---|---|---|---|
| 2,496,520 | 2/1950 | Daniel | 4/596 X |
| 2,685,093 | 8/1954 | Lundquist | 4/191 |
| 2,697,839 | 12/1954 | Jackson | 4/191 |
| 3,005,995 | 10/1961 | Bickford | 4/191 |
| 3,048,851 | 8/1962 | Bickford | 4/191 |
| 3,616,466 | 11/1971 | Davis | 4/191 |
| 3,737,107 | 6/1973 | Wright | 239/588 |
| 4,174,822 | 11/1979 | Carsson | 248/75 |
| 4,271,543 | 6/1981 | Martin | 4/615 |
| 4,360,159 | 11/1982 | Haynes | 239/282 |
| 4,561,136 | 12/1985 | Baer | 4/615 |

FOREIGN PATENT DOCUMENTS

| | | | |
|---|---|---|---|
| 91242 | 9/1961 | Denmark | 248/295.1 |
| 2445870 | 9/1980 | France | 4/605 |
| 2514245 | 4/1983 | France | 4/605 |

*Primary Examiner*—William A. Cuchlinski, Jr.
*Assistant Examiner*—R. Fetsuga
*Attorney, Agent, or Firm*—Shoemaker and Mattare, Ltd.

[57] ABSTRACT

An adjustable showerhead assembly is provided being composed of an elongated member having a slot therein through which a showerhead assembly passes. Locking means are provided for adjustably positioning the showerhead. Different embodiments of the device are shown.

1 Claim, 7 Drawing Sheets

ADJUSTABLE SHOWER HOLDER

This application is a continuation-in-part of Application Ser. No. 07/093,754, filed 09/08/87 now abandoned.

BACKGROUND OF INVENTION

The field of the present invention generally relates to shower accessories and showerhead holders and is more particularly directed to an apparatus for adjustably holding a showerhead assembly for use in bath and shower-room enclosures.

Devices for holding showerheads have been described in the prior art. Baer, in U.S. Pat. No. 4,561,136, described an adjustable showerhead assembly. Larsson, in U.S. Pat. No. 4,174,822, described an invention providing a simplified shower holder combination adapted to be easily adjustable. Martin, in U.S. Pat. No. 4,271,543, described a shower device having a bar on which a spray head support could slide having a manually operable grip. Wright, in U.S. Pat. No. 3,737,107, described a device allowing for the vertical adjustment of a showerhead to a plurality of elevations. Haynes, in U.S. Pat. No. 4,360,159, described an adjustable shower assembly for adjustably mounting a showerhead.

However, none of the prior art contains the unique and new features of the present invention.

SUMMARY OF THE INVENTION

The device generally consists of an elongated member having a slot therein through which the showerhead passes. The slotted elongated member is either equipped with a locking means or provides the locking means itself due to its own elasticity for adjustably positioning said showerhead to the elongated member. Different embodiments of the locking means are presented herein.

The primary objective of these and various other objects and advantages of the invention will become readily apparent to those skilled in the art upon reading the following detailed description and claims and by referring to the accompanying drawings.

The above objects are attained in accordance with the present invention by the provision of a combination of elements fabricated to a manner substantially described in the specification and abstract.

Thus, while the present invention has been disclosed and described with respect to preferred embodiments thereof, it will be understood by those skilled in the art that various changes in form and detail may be made therein without departing from the spirit and scope of the invention.

BRIEF DESCRIPTION OF THE DRAWINGS

FIG. 8 is an enlarged fragmentary sectional view taken substantially along lines 8—8 of FIG. 7.

DESCRIPTION OF THE PREFERRED EMBODIMENT(S)

Figure 1:
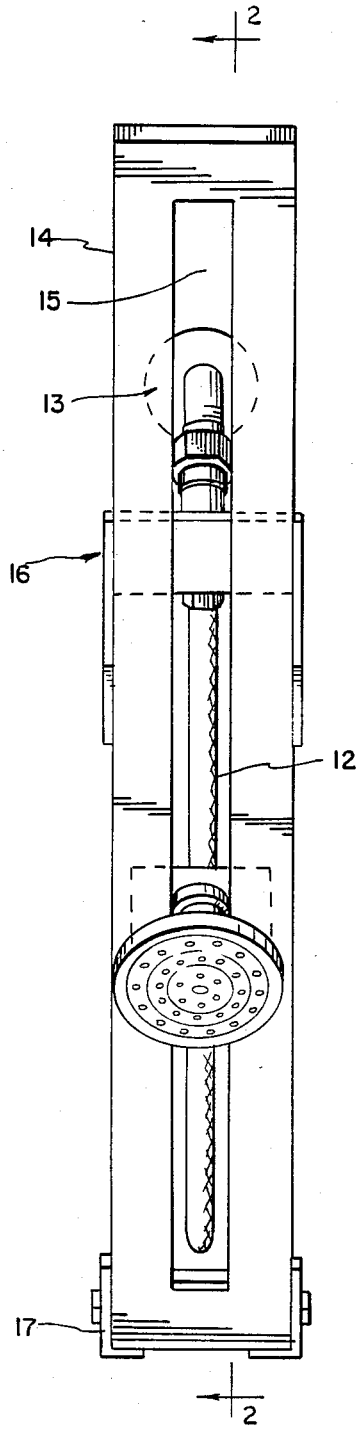
FIG. 1 is a elevation view of a first embodiment of the present invention.

Turning to FIG. 1, the present invention is shown in elevation view. In FIG. 1, at 11, the showerhead is shown having a hose, 12, connected thereto running from, 13, the wall mounting bracket of the water supply pipe. At 14, an elongated member having a slot, 15, therein is shown. At 16, an upper mounting bracket is shown and at 17, a lower mounting bracket.

Figure 2:
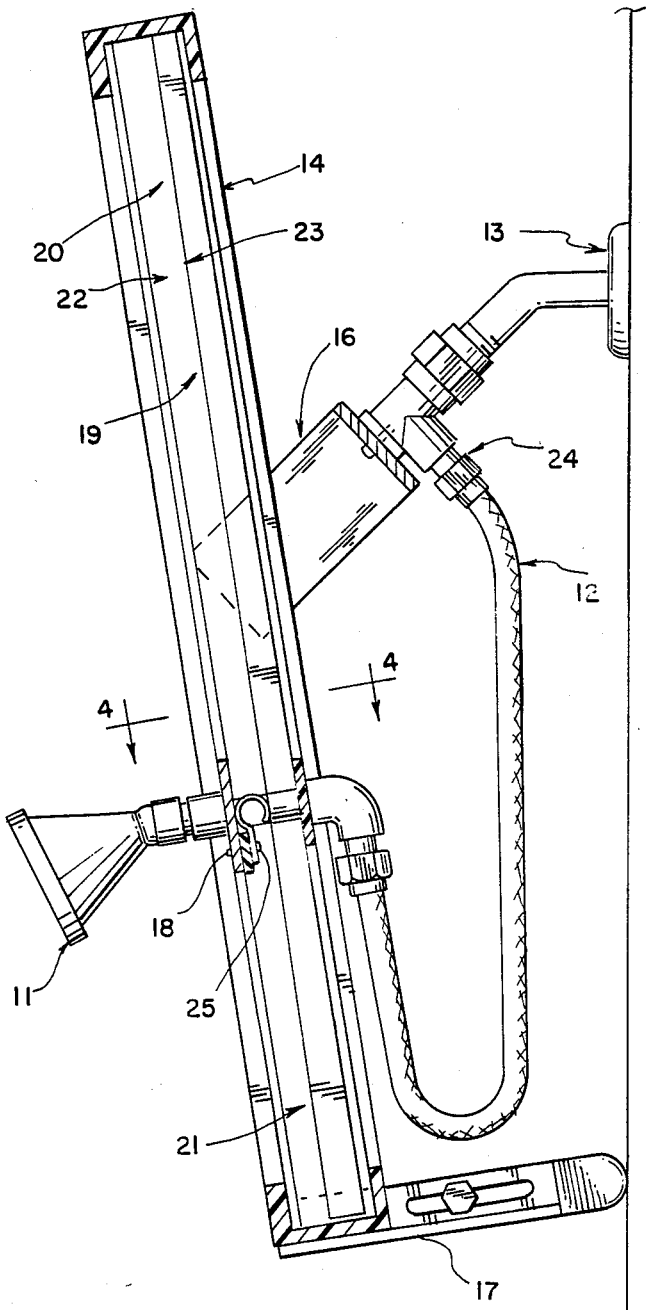
FIG. 2 is a sectional view taken along lines 2—2 of FIG. 1.

Turning to FIG. 2, a sectional view of the present invention is shown. The features of FIG. 1 are also shown therein. Additionally in FIG. 2, at 18, is shown a spring locking means attached to the showerhead. The spring travels in a space shown at 19 which varies in longitudinal width from top to bottom, i.e., from it's upper to lower end, being wider at 20 than at 21 for example. The space, 19, has a front face, 22, and a rear surface or face, 23. Additionally shown in FIG. 2 are hose connecting means to the water supply pipe shown as 24, and spring attaching means, 25, for attaching the spring locking means to the adjustable showerhead.

Figure 3:
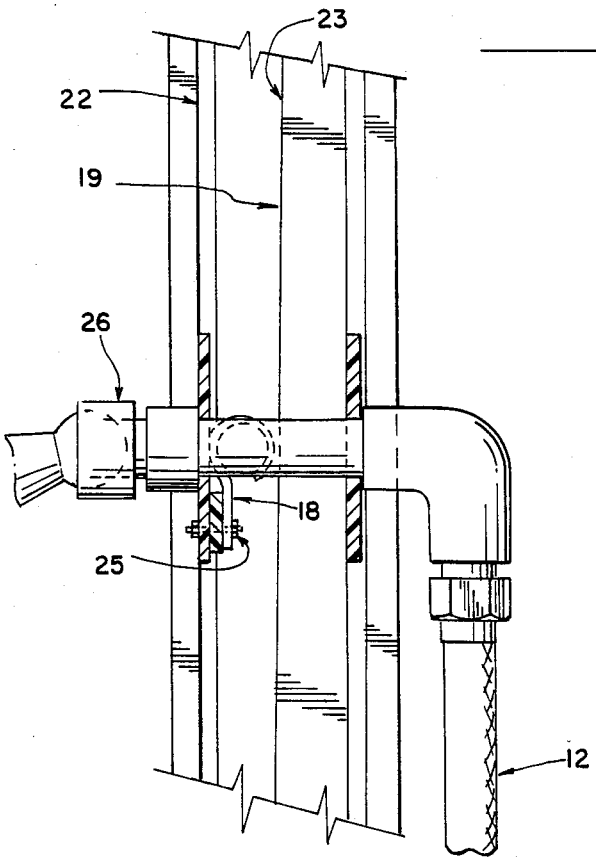
FIG. 3 is a sectional view taken along lines 3—3 of FIG. 4.

Turning to FIG. 3, a sectional view of a first embodiment of the present invention is shown. Additional details of the previously mentioned features are shown. Additionally at, 26, connecting means for connecting the showerhead to a water hose adapter is shown. In FIG. 3, additional detail of the spring locking means, 18, is shown contacting the rear surface or face, 23 of the slotted space. Note that the spring member is used as a continuous pressure clamp for locking the shower in the desired position. Also note that the width of the slotted space varies from top to bottom. Additionally, shown at 25 is the spring attaching means for attaching the spring locking means to the adjustable showerhead.

Figure 4:
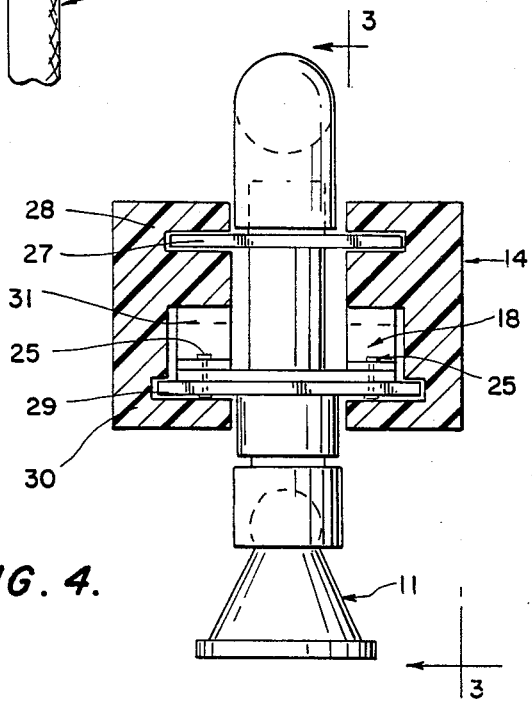
FIG. 4 is a sectional view taken along lines 4—4 of FIG. 2.

Turning to FIG. 4, additional features of the present invention are shown. At 18 is shown the spring locking means and for the first time it is shown that there are dual springs being at 18 and 31 each spring locking means, 18 and 31, is attached to a sliding plate at 25, the sliding plate being shown at 29 operating in a slot, 30. Furthermore, a front sliding plate guide is shown at 27 being in a front slot 28.

Figure 5:
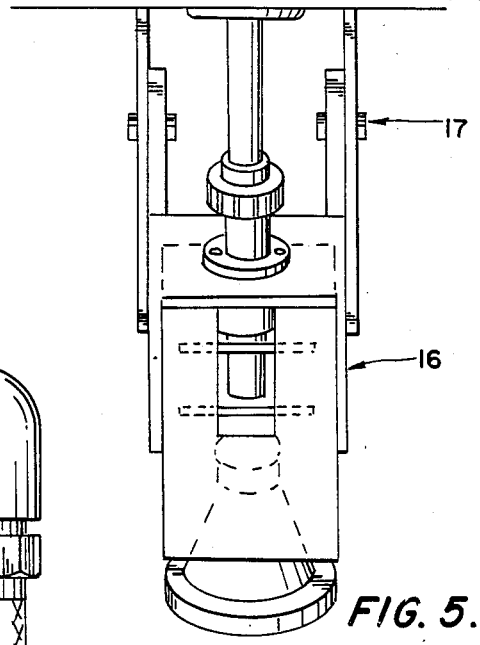
FIG. 5 is a top plan view of FIG. 1.

Turning to FIG. 5, the upper mounting bracket is shown at 16 and the lower mounting bracket is shown at 17.

Figure 6:
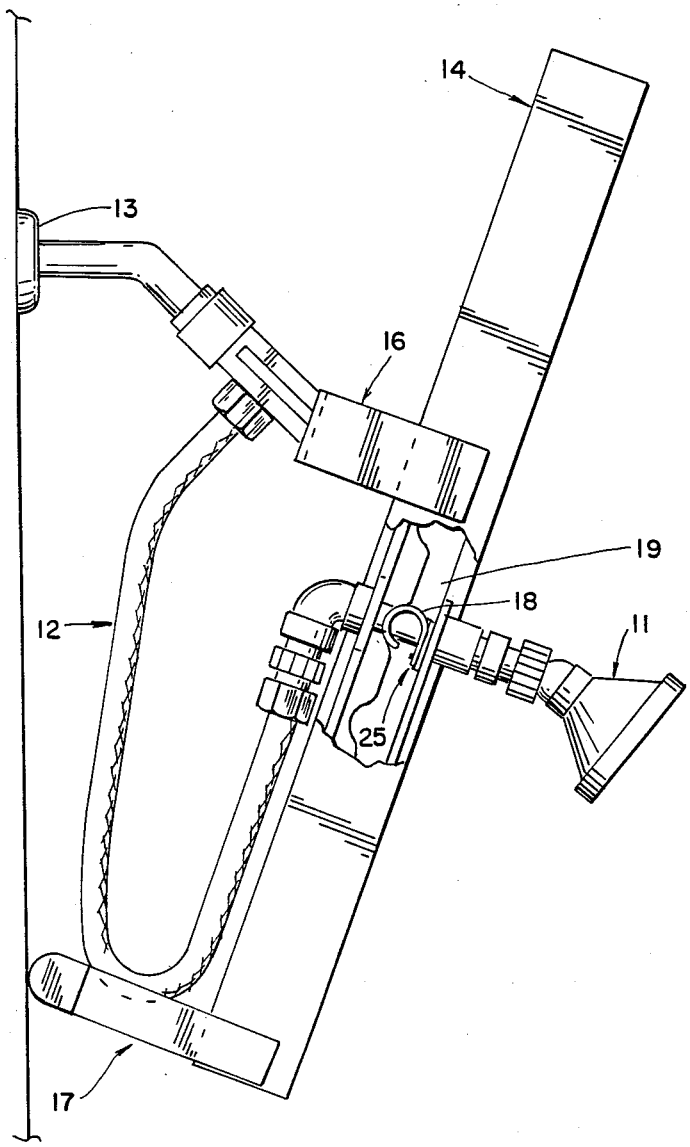
FIG. 6 is an elevation view of a second embodiment of the present invention.

Turning to FIG. 6, a second embodiment of the present invention is shown. Pertinent features similar to the first embodiment described in FIG. 1 are shown. At 11, is shown the showerhead, at 12, is shown the hose, at 13, is shown the wall mounting bracket, at 16, is shown the upper mounting bracket, at 17, is shown a lower mounting bracket and at 14, the elongated member having a slot, 19 therein is shown. Spring locking means is shown at 18 and attaching means for attaching said spring locking means to the adjustable showerhead is shown at 25.

Figure 7:
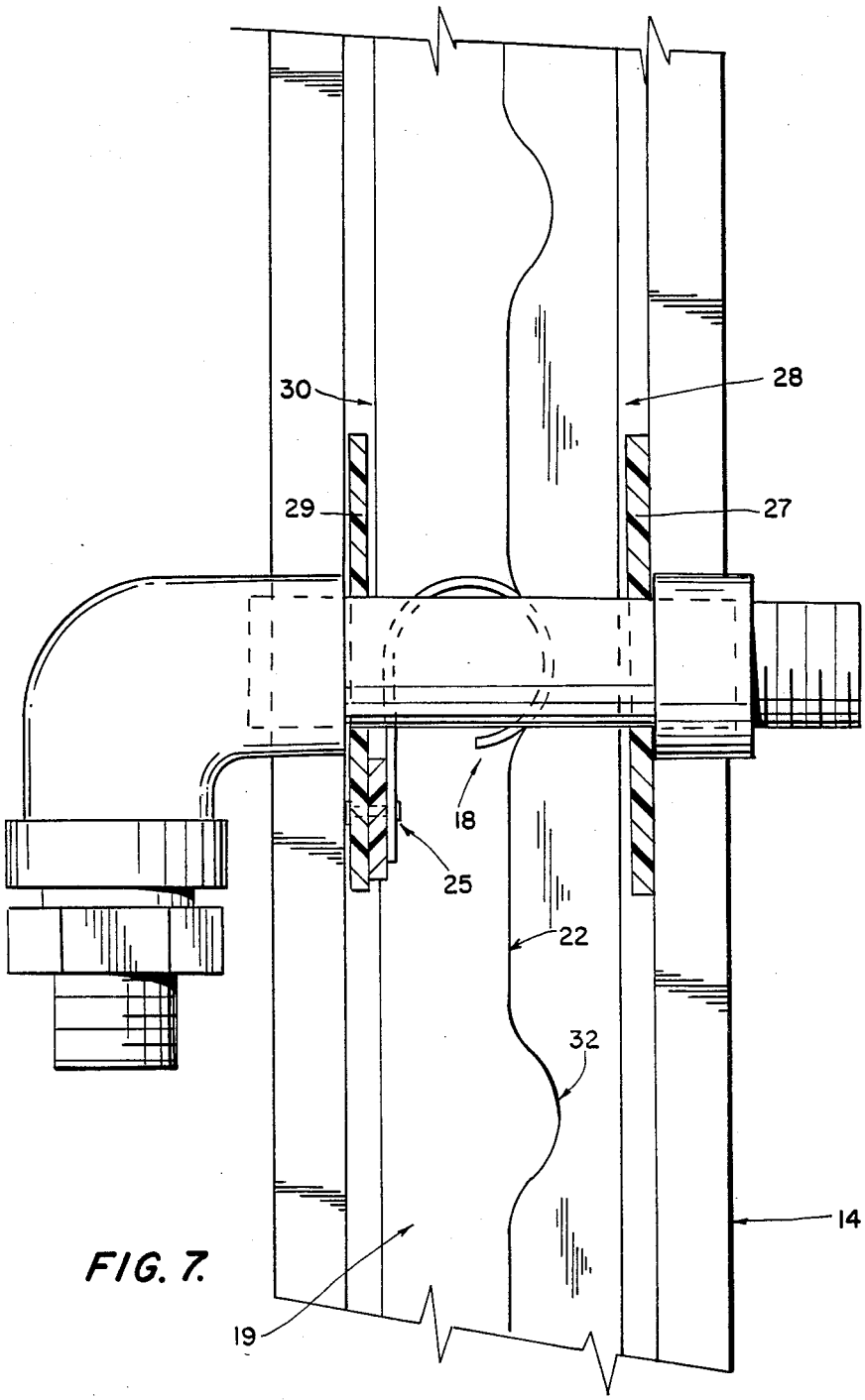
FIG. 7 is an enlarged sectional view of the broken portion of FIG. 6.
Figure 3:
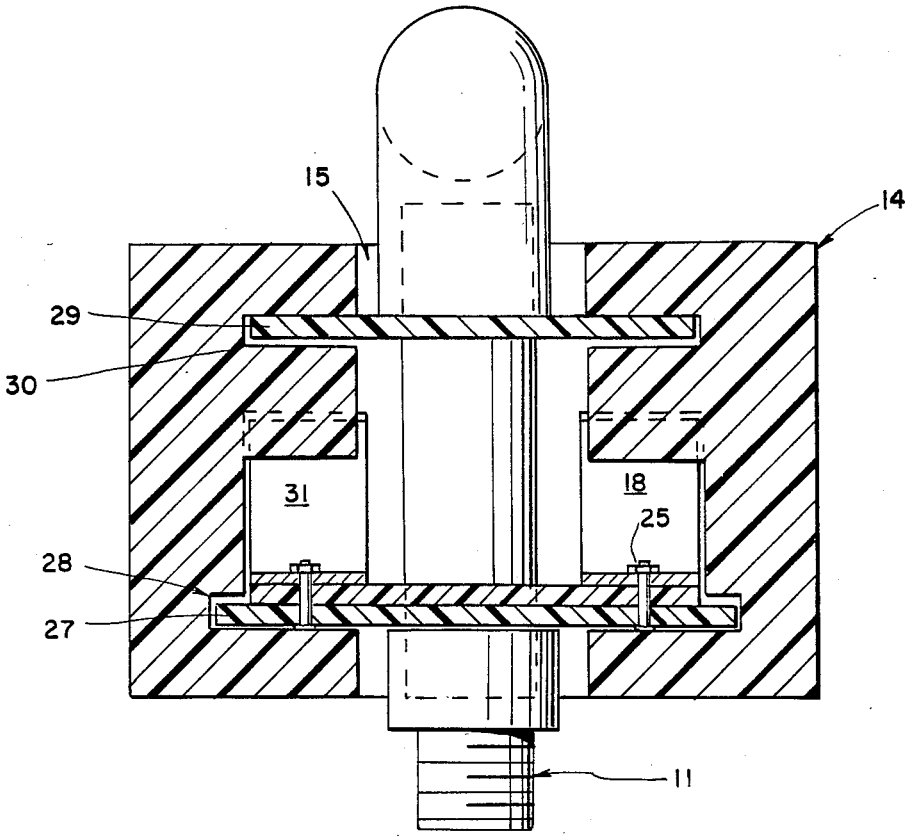

Turning to FIG. 7, a sectional view of the second embodiment of the present invention is shown. Pertinent features as previously discussed are shown of the second embodiment. At 14 is shown the elongated member having a slot therein and at 19 is shown a space wherein the spring locking means travels. At 22, a front face of the space is shown having a depression therein at 32. The purpose of the depressions, 32, is to provide a locking position for the spring locking means to lock the adjustable showerhead at a desired position or elevation. Front and rear sliding plates, 27 and 29, are shown in their slots 28 and 30. Furthermore, at 25 is shown an attaching means for attaching the locking means to the moveable showerhead assembly.

Turning to FIG. 8 of the second embodiment, a sectional view similar to FIG. 4 of the first embodiment is depicted. The elongated member is shown at 14 having a slot therein 15. The dual spring locking means are shown at 18 and 31, having attaching means at 25. A front sliding plate is shown at 27 and the front slot at 28. The rear sliding plate is shown at 29 and the rear slot at 30. Furthermore, the moveable showerhead assembly is shown at 11.

Figure 9:
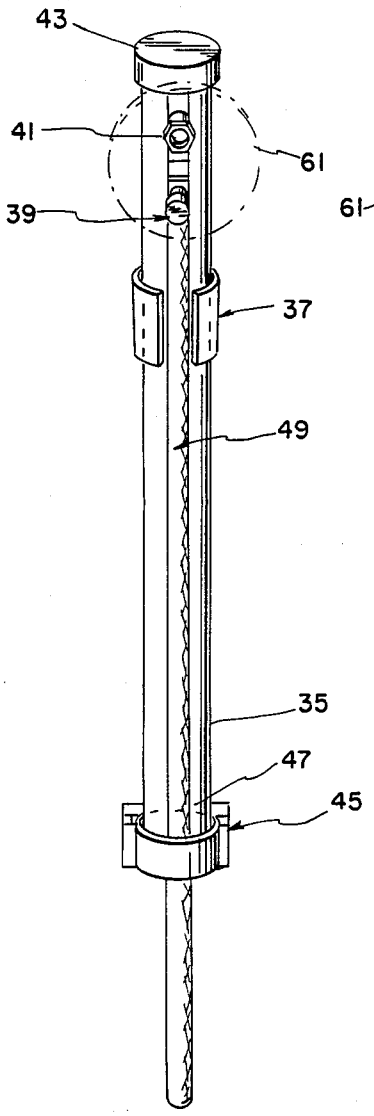
FIG. 9 is a front elevation view of a third embodiment of the present invention.

Turning to FIG. 9, a front elevation view of a third embodiment is depicted. The elongated member 35 being hollow such as by having a cavity therein, is shown having a slot, 49, therein. However this third embodiment differs from the previous embodiments in that the elongated member is made out of a resilient or other material having elastic qualities so that it provides a locking means on the shower head by squeezing against a friction holding member or guide or means, 39. The friction holding guide also serves to keep the shower nozzle assembly, 41, from rotating in the slot, 49. The elongated member will be referred to hereinafter as the continuous spring elongated member which is show as 35 in FIG. 9. Furthermore, FIG. 9 depicts the mounting bracket of the continuous spring elongated member at 37. Additionally, there is shown the shower nozzle assembly, 41, and a cap, 43 on the upper end of the continous spring elongated member. Furthermore, there is depicted a wall contacting member, 45, having a roller or like device, 47, for providing movement of the bottom end of the continuous spring elongated member as the bottom end contacts the wall. In operation, the width of the slot, 49, is effectively less than the diameter or width of the friction holding member or means, 39, so that friction is applied to the friction holding member by the continuous spring elongated member as the friction holding member is in continuous contact with and slides up and down the slot in the continuous spring elongated member. This is accomplished by the friction holding member being squeezed between the two faces on opposite sides of the slot.

Figure 10:
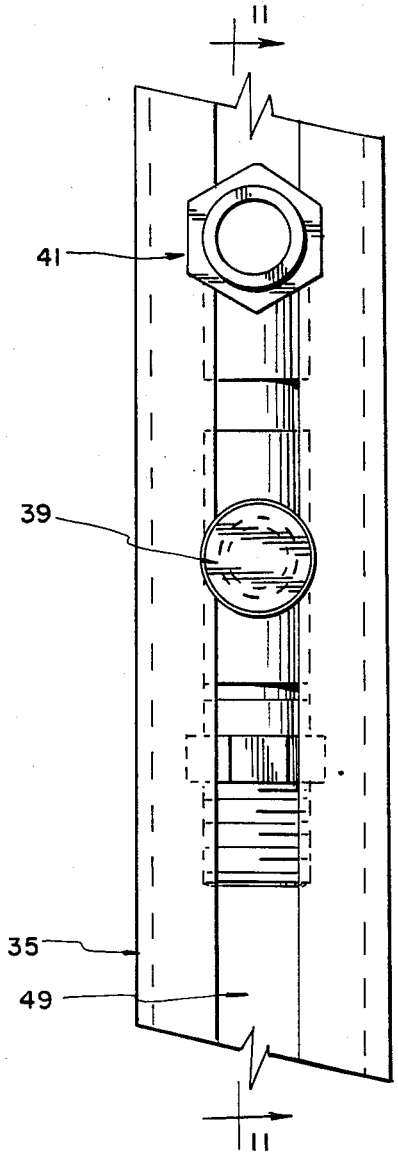
FIG. 10 is a fragmentary view of the third embodiment of the invention.

Turning to FIG. 10, a front sectional view of the continuous spring elongated member, 35, is shown being hollow in design and having a slot, 49, cut in one face of it. Furthermore, therein is shown the friction holding member, 39, and the shower nozzle assembly, 41.

Figure 11:
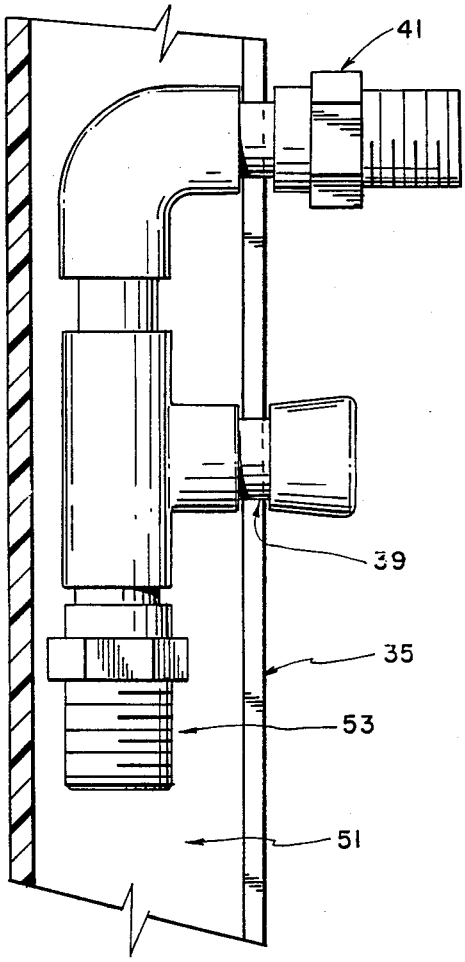
FIG. 11 is a fragmentary sectional view taken substantially along lines 11—11 of FIG. 10.

Turning to FIG. 11, therein is shown a side cross sectional view of the continuous spring elongated member, 35, being hollow in design having a cavity therein shown at 51. Furthermore, there is depicted the friction holding member, 39, the shower nozzle assembly, 41, having connecting means whereby there is connected thereto a threaded hose coupling, 53.

Figure 12:
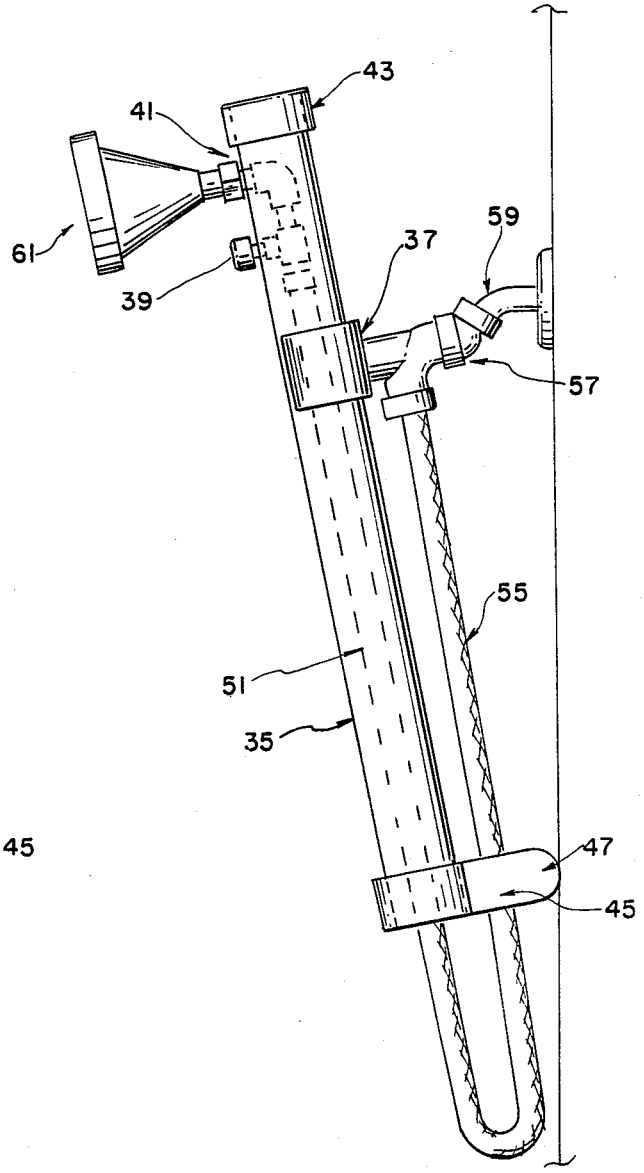
FIG. 12 is a side elevation view of a third embodiment of the present invention shown in operative connection.

Turning to FIG. 12, therein is shown a side elevation of the third embodiment of the present invention in operative connection. Therein is shown the continuous spring elongating member, 35, having a hollow cavity therein, 51. Furthermore, there is shown the friction holding member, 39, the shower nozzle assembly, 41, the cap, 43, on the upper end of the continuous spring elongated member, the wall contacting member, 45, and the roller assembly of the wall contacting member, 47. Furthermore the mounting bracket of the continuous spring elongated member is shown at 37, along with the hose at 55. Additionally, there is shown connecting means whereby the hose is connected to the shower water pipe at 59. Furthermore the shower head is shown at 61. Note that the connecting means whereby the hose is connected to the shower water pipe, shown at 57, is constructed in a single piece and manufactured as a part of the mounting bracket of the continuous spring elongated member shown at 37.

The operation of the present invention is as follows. The operator simply grasps the moveable showerhead assembly and urges it either up or down the elongated member. As the showerhead assembly is moved the spring locking means attaches according to embodiment one or according to embodiment two or the friction holding member is held by the continuous spring elongated member according to embodiment three. Thereby, various elevations of the showerhead can be provided to the operator very simply and easily. Furthermore, the alternate locking means of the various embodiments are very stable and would not allow slippage of the showerhead either up or down. Furthermore, the showerhead elevation adjustment is very simple and can be accomplished by one having his eyes closed such as might occur in a shower.

It is obvious that the present invention could be composed of many materials. However, it is anticipated that the invention will be constructed of some type of plastic or like material so as to be inexpensively and easily manufactured.

It is obvious from the foregoing that the invention can be manufactured in many different embodiments. The foregoing discussion is meant to be for illustrative purposes only and is not to be read as limiting the scope of the invention to only the embodiments shown but should be read in light of the many obviously potential embodiments.

I claim:

1. An apparatus for adjustably holding a showerhead assembly comprising:

an elongated housing having a hollow interior and including a slot formed therein opening said hollow interior to the exterior of said housing;

said elongated housing further having elastic qualities;

a showerhead extending through said slot and having a water inlet end disposed within said hollow interior;

a friction holding means extending through said slot and connected to said showerhead proximate said water inlet end;

said friction holding means being wider than the width of said slot; whereby said showerhead is adjustably positioned by said friction holding means contacting the opposite inside faces of said slot in said elongated housing;

a mounting bracket connected to said elongated housing for mounting said housing on a shower water pipe;

a hose having a first connection to said water inlet end of said showerhead and a second connection adapted to be secured to the shower water pipe; and, said mounting bracket and second hose connection singly constructed.

* * * * *